US010913555B2

(12) United States Patent
Dersch et al.

(10) Patent No.: US 10,913,555 B2
(45) Date of Patent: Feb. 9, 2021

(54) DISPENSING DEVICE FOR ARRANGEMENT IN THE FORMAT TUBE OF A TUBULAR BAG MACHINE

(71) Applicant: ROVEMA GMBH, Fernwald (DE)

(72) Inventors: Volker Dersch, Gruenberg (DE); Gunter Brueck, Reiskirchen (DE)

(73) Assignee: ROVEMA GMBH, Fernwald (DE)

( * ) Notice: Subject to any disclaimer, the term of this patent is extended or adjusted under 35 U.S.C. 154(b) by 154 days.

(21) Appl. No.: 16/089,435

(22) PCT Filed: Mar. 7, 2017

(86) PCT No.: PCT/EP2017/055233
§ 371 (c)(1),
(2) Date: Sep. 28, 2018

(87) PCT Pub. No.: WO2017/174273
PCT Pub. Date: Oct. 12, 2017

(65) Prior Publication Data

US 2019/0135460 A1 May 9, 2019

(30) Foreign Application Priority Data

Apr. 7, 2016 (DE) ..... 10 2016 205 859

(51) Int. Cl.
*B65B 1/12* (2006.01)
*B65B 37/10* (2006.01)
(Continued)

(52) U.S. Cl.
CPC ..... *B65B 1/12* (2013.01); *B65B 9/20* (2013.01); *B65B 9/22* (2013.01); *B65B 37/10* (2013.01); *B65B 59/04* (2013.01)

(58) Field of Classification Search
CPC ..... F16B 21/18; F16B 21/186; B65B 1/06; B65B 1/12; B65B 1/42; B65B 37/10; B65B 39/001–005
(Continued)

(56) References Cited

U.S. PATENT DOCUMENTS 808,588 A * 12/1905 Tracy ..... A63H 27/10 141/313
1,871,655 A * 8/1932 Bond ..... B65B 39/004 222/372
(Continued)

FOREIGN PATENT DOCUMENTS

CN 104724437 A 6/2015
DE 2850668 A1 5/1980
(Continued)

*Primary Examiner* — Stephen F. Gerrity
*Assistant Examiner* — Joshua G Kotis
(74) *Attorney, Agent, or Firm* — King & Schickli, PLLC

(57) ABSTRACT

The invention relates to a dispensing device (40) for being disposed in the forming tube (42) of a tubular bag machine (01) for the portioned dispensation of a flowable, in particular powdery, product (46), having at least one screw conveyor (43) discharging the product (46), said screw conveyor (43) protruding into a screw tube (41) with its longitudinal axis and being able to be rotationally driven by a drive, and having a flow barrier (45) fastened at the lower end of the screw tube (41), the amount of the product (46), which trickles down when the screw conveyor (43) is stopped, being able to be reduced by the flow barrier (45), at least one first receiving contour being provided at the flow barrier (45), and at least one second receiving contour being provided at the lower end of the screw tube (41), and a locking bolt being able to be inserted into and/or pushed through the first receiving contour and second receiving contour when disposing the flow barrier (45) at the lower end of the screw tube (41) in order to fixate the flow barrier
(Continued)

(45) between the locking bolt and the two receiving contours at the lower end of the screw tube (41) in a form-fit manner.

17 Claims, 6 Drawing Sheets

(51) Int. Cl.
*B65B 59/04* (2006.01)
*B65B 9/20* (2012.01)
*B65B 9/22* (2006.01)

(58) Field of Classification Search
USPC .... 141/383–386, 10, 255, 264; 53/551, 552, 53/451; 403/DIG. 7; 285/305, 321
See application file for complete search history.

(56) References Cited

U.S. PATENT DOCUMENTS 2,686,618 A * 8/1954 Mateer ..... B65B 37/10 418/48
3,411,745 A * 11/1968 Austin, Jr. ..... B67C 3/26 251/129.15
3,820,691 A * 6/1974 Saur ..... B65B 39/001 222/560
3,879,917 A 4/1975 Bassendale et al.
4,587,795 A * 5/1986 Yamashita ..... B65B 9/2042 222/504
4,923,350 A * 5/1990 Hinksman ..... F16L 37/144 411/457
5,593,187 A * 1/1997 Okuda ..... F16L 37/088 285/305
5,832,700 A * 11/1998 Kammler ..... B29C 66/1122 53/502
8,413,954 B1 * 4/2013 Burrow ..... B65B 39/001 251/147
8,539,995 B2 * 9/2013 Smith ..... B65G 69/183 137/614.04
2003/0160448 A1 * 8/2003 Takayanagi ..... F16L 37/098 285/305
2007/0040380 A1 * 2/2007 Benstead ..... E03C 1/0404 285/321
2009/0293414 A1 * 12/2009 Keohan ..... E04F 21/1652 52/742.16

FOREIGN PATENT DOCUMENTS

DE 3640520 A1 6/1988
DE 3925577 A1 * 2/1990 ..... B65G 65/32
DE 19628098 A1 1/1998
EP 0275569 A2 * 7/1988 ..... B65B 39/002
WO WO2010007691 A1 1/2010

* cited by examiner

DISPENSING DEVICE FOR ARRANGEMENT IN THE FORMAT TUBE OF A TUBULAR BAG MACHINE

FIELD OF THE INVENTION

The invention relates to a dispensing device for being disposed in the forming tube of a tubular bag machine for the portioned dispensation of a flowable, in particular powdery, product. Generic dispensation devices are used for filling tubular bags in tubular bag machines. The product can be filled from a storage container into the tubular bag, which is produced in the tubular bag machine, by means of a screw conveyor stored in a rotationally drivable manner in a screw tube. The number of rotations of the screw conveyor—tubular bag in this instance—corresponds to the amount of product which has to be filled into the tubular bag in a defined manner.

SUMMARY OF THE INVENTION

From DE 196 28 098 A1, a vertical tubular bag machine is known having a generic dispensation device. At the lower end of the screw tube, a so-called seal is fastened which can be opened and closed in sync with the conveying movement of the screw conveyor. The seal is closed when the screw conveyor is stopped. As soon as the screw conveyor is driven, the seal opens in order to enable filling the tubular bag with the product. The point of closing the seal when the screw conveyor is stopped is to prevent the product from trickling down when the screw conveyor is stopped. In particular powdery products, such as milk powder, can trickle down in small amounts from the end of the screw conveyor even when the screw conveyor is stopped. This uncontrolled and undefined dispensation of the product is unintended and can lead to disruptions in the production of tubular bags, in particular when the trickling product gets into the gap of the tubular bag material to be heat-sealed. As described in DE 196 28 098 A1, the seal consequently serves as a flow barrier by means of which a trickling down of the product when the screw conveyor is stopped is reduced or precluded.

Besides such flow barriers realized as seals, other types of flow barriers for being used at the screw tubes of tubular bag machines are also known. Thus, the flow barrier can also be realized as a sieve, a flap, a cone or a vacuum seal. All functioning elements, which are fastened to the end of the screw conveyor and reduce the amount of product trickling down when the screw conveyor is stopped, are to be understood as being flow barriers in the scope of this invention.

From the state of the art, different fastening options for fastening the flow barriers at the lower end of the screw tube are known. The most commonly used fastening options are those, in which a screw connection is intended between the flow barrier and the screw tube. A disadvantage of such screw connections is that the fastening screws repeatedly become loose unintentionally. Should the fastening screw become loose, however, it falls into the tubular bag below together with the product and can be a cause of risk for consumers of this product. Should the user of a tubular bag machine notice a fastening screw to be missing, large numbers of the tubular bags filled with the product have to be recalled, thus posing a large damage risk.

Alternatively thereto, to fasten the flow barrier at the lower end of the screw conveyor it is also known to fasten the flow barrier at the screw conveyor by means of a weld connection. The disadvantage of this kind of fastening, however, is that the flow barrier cannot be exchanged.

Starting from the state of the art, it is the objective of the present invention to propose a new dispensation device for being disposed in the forming tube of a tubular bag machine, the flow barrier being able to be fastened in an exchangeable manner in said dispensation device and an unintended loosening and falling off of the fastening means being essentially precluded at the same time.

BRIEF DESCRIPTION OF THE DRAWING FIGURES

This object is attained by a dispensation device according to the teachings of claim 1.

Advantageous embodiments of the invention are the subject matter of the dependent claims.

The fundamental idea of the dispensing device according to the invention is to use a fastener for fastening the flow barrier to the screw conveyor, said fastener being inserted into or pushed through a receiving contour at the fastener and a second receiving contour at the screw conveyor. When the fastener is pushed through, a form fit is formed between the fastener and the two receiving contours and thus a falling off of the flow barrier is precluded. Moreover, an unintended loosening of the fastener during operation of the dispensing device is generally precluded through the size of the fastener and the form fit so that production disruptions are precluded via a falling fastening means as can occur in the known state of the art from falling fastening screws.

In which manner the fastener and the two receiving contours for the form-fit connection of the screw conveyor to the flow barrier are realized is generally arbitrary. According to a first alternative, the end cross section of the flow barrier facing towards the screw tube is inserted onto the end of the screw tube. The first receiving contour is realized at the flow barrier like a perforation which entirely engages through the wall of the flow barrier. The wall of the screw tube disposed on the inner side of the wall of the flow barrier has a groove which serves as a second receiving contour. For the form-fit connection between the flow barrier and the screw tube, the fastener is inserted such that it engages through the perforation in the wall of the flow barrier and simultaneously engages in the groove at the end of the screw tube therebehind.

According to a second embodiment, the end cross section of the flow barrier facing the screw tube can be inserted into the end of the screw tube. In this instance, the first receiving contour is formed in the flow barrier like a groove, whereas the end of the screw tube comprises at least one perforation as a second receiving contour. For the form-fit connection of the flow barrier and the screw tube, the fastener in turn is inserted such that it engages through the perforation in the wall of the screw tube and simultaneously engages into the groove of the flow barrier therebehind in a fixating manner.

How large the groove is at the circumference of the screw tube or at the circumference of the flow barrier is generally arbitrary, as long as a sufficiently form-fit connection is ensured when inserting or pushing through the fastener. It is particularly advantageous if the groove annularly surrounds the circumference of the screw tube or the circum-ference of the flow barrier. Via the annular groove, angle tolerances between the flow barrier and the screw tube can be compensated without problems when fastening the flow barrier to the screw tube since a groove section, in which the flow barrier engages in a fixating manner, is always available regardless of the relative angle between the flow barrier and the screw tube.

The constructional embodiment of the fastener is also generally arbitrary. It is particularly advantageous if the fastener is realized like a push clamp having two arms which each serve for a form-fit connection between the fastener and screw tube. The wall of the fastener or the wall of the screw tube has two perforations in each instance when using such a push clamp having two arms so that the two arms can engage through the perforations and then each engage in the groove therebehind in a fixating manner. The two arms of the push clamp are connected to each other via a connecting web. The connecting web also serves for manipulating the push clamp when inserting or extracting the push clamp.

The fundamental idea of the dispensing device according to the invention is to use a fastener for fastening the flow barrier to the screw conveyor, said fastener being inserted into or pushed through a receiving contour at the fastener and a second receiving contour at the screw conveyor. When the fastener is pushed through, a form fit is formed between the fastener and the two receiving contours and thus a falling off of the flow barrier is precluded. Moreover, an unintended loosening of the fastener during operation of the dispensing device is generally precluded through the size of the fastener and the form fit so that production disruptions are precluded via a falling fastening means as can occur in the known state of the art from falling fastening screws.

In which manner the fastener and the two receiving contours for the form-fit connection of the screw conveyor to the flow barrier are realized is generally arbitrary. According to a first alternative, the end cross section of the flow barrier facing towards the screw tube is inserted onto the end of the screw tube. The first receiving contour is realized at the flow barrier like a perforation which entirely engages through the wall of the flow barrier. The wall of the screw tube disposed on the inner side of the wall of the flow barrier has a groove which serves as a second receiving contour. For the form-fit connection between the flow barrier and the screw tube, the fastener is inserted such that it engages through the perforation in the wall of the flow barrier and simultaneously engages in the groove at the end of the screw tube therebehind.

According to a second embodiment, the end cross section of the flow barrier facing the screw tube can be inserted into the end of the screw tube. In this instance, the first receiving contour is formed in the flow barrier like a groove, whereas the end of the screw tube comprises at least one perforation as a second receiving contour. For the form-fit connection of the flow barrier and the screw tube, the fastener in turn is inserted such that it engages through the perforation in the wall of the screw tube and simultaneously engages into the groove of the flow barrier therebehind in a fixating manner.

How large the groove is at the circumference of the screw tube or at the circumference of the flow barrier is generally arbitrary, as long as a sufficiently form-fit connection is ensured when inserting or pushing through the fastener. It is particularly advantageous if the groove annularly surrounds the circumference of the screw tube or the circum-ference of the flow barrier. Via the annular groove, angle tolerances between the flow barrier and the screw tube can be compensated without problems when fastening the flow barrier to the screw tube since a groove section, in which the flow barrier engages in a fixating manner, is always available regardless of the relative angle between the flow barrier and the screw tube.

The constructional embodiment of the fastener is also generally arbitrary. It is particularly advantageous if the fastener is realized like a push clamp having two arms which each serve for a form-fit connection between the fastener and screw tube. The wall of the fastener or the wall of the screw tube has two perforations in each instance when using such a push clamp having two arms so that the two arms can engage through the perforations and then each engage in the groove therebehind in a fixating manner. The two arms of the push clamp are connected to each other via a connecting web. The connecting web also serves for manipulating the push clamp when inserting or extracting the push clamp.

A fixation, which is in particular free of play, when using the push clamp is yielded if the groove and/or the two arms of the push clamp each have a rectangular cross section.

The shape of the perforations in the wall in the flow barrier or in the wall of the screw conveyor is generally arbitrary. It is particularly advantageous if the perforations are realized like slits which tangentially perforate the circumference of the flow barrier or the circumference of the screw tube.

The arms of the installed push clamp should preferably be disposed in a push plane extending orthogonal to the longitudinal axis of the screw tube.

In order to reliably preclude the loosening of the push clamp from the fastening position, the two arms of the push clamp should be at least slightly widened elastically when being pushed through the two perforations in the wall of the flow barrier or the screw tube. Via the subsequent resilience of the two arms of the push clamp when in their fastening position, it is ensured that the push clamp can be extracted only when exerting a sufficiently large removal force, for example by the user. Vibrations alone can no longer budge the push clamp from its fastening position owing to the resilience of the arms of the push clamp.

The push clamp can be secured against an unintended loosening from its fastening position by the connecting web of the installed push clamp being disposed in the gap between the screw tube and the forming tube. In order to prevent an unintended extraction of the push clamp, the distance between the screw tube and the forming tube has to be smaller than the extraction path required for extracting the push clamp. In such a configuration, it is therefore necessary in each instance to pull back the screw tube from the forming tube for mounting or extracting the push clamp since otherwise the push clamp could not be extracted from its fastening position.

In order to ensure a precise relative angle between the flow barrier and the screw tube, for example in motor-driven flow barriers having half-shell-shaped sealing shells in this instance, it is particularly advantageous if at least one anti-rotation element is provided at the flow barrier and engages in the wall of the screw tube in a form-fit manner when disposing the flow barrier at the lower end of the screw tube. Owing to the form fit of the anti-rotation element, a precise mounting angle is ensured between the flow barrier and the screw tube, which facilitates in particular mounting drive elements to the flow barrier.

Constructively, the anti-rotation element can be realized like a protrusion which engages in a cutout at the end cross section of the screw tube in a form-fit manner when disposing the flow barrier at the lower end of the screw tube.

DETAILED DESCRIPTION OF THE INVENTION

An embodiment of the invention is schematically illustrated in the drawings and is described in an exemplary manner in the following.

In the following,

BACKGROUND OF THE INVENTION

Figure 1:
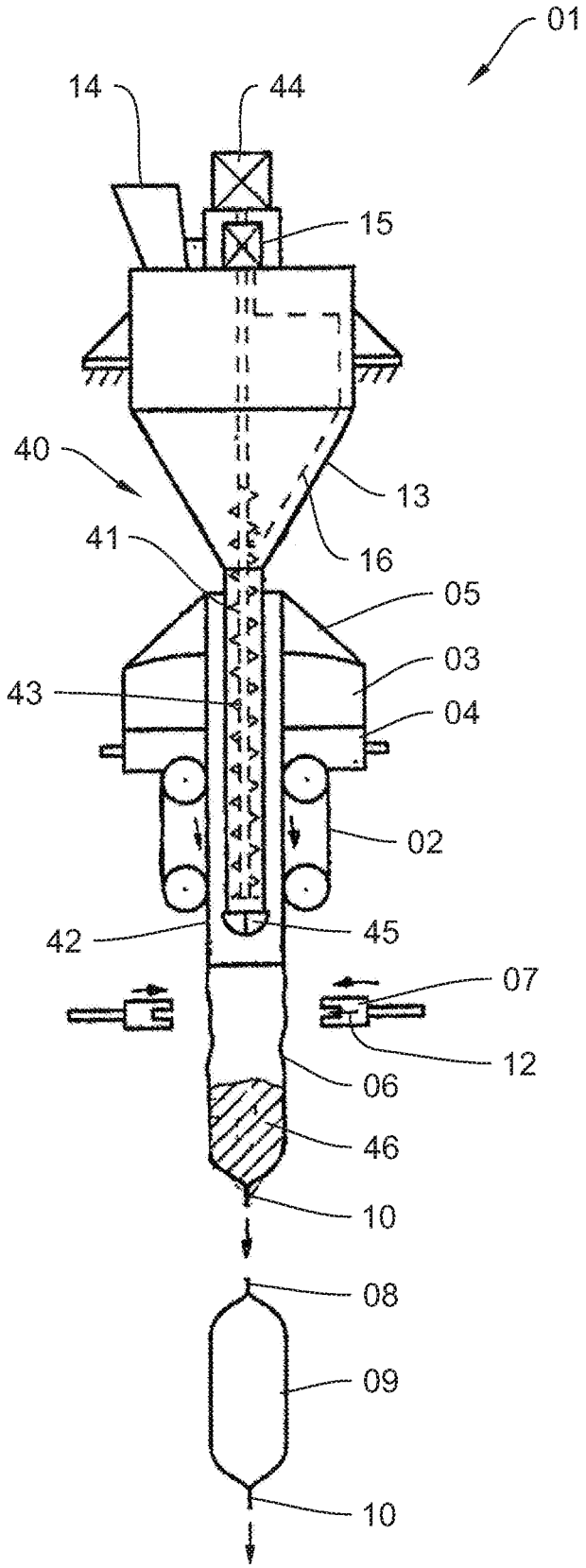
FIG. 1 illustrates in a side view a schematically illustrated tubular bag machine having a dispensing device for the portioned dispensation of a flowable product.

FIG. 1 illustrates in a side view in a general presentation a vertical tubular bag machine 01. In the tubular bag machine 01, a level film sheet 03 is withdrawn from a supply roll 04 by means of a film withdrawal 02 and reshaped to a film tube 06 via a forming shoulder 05. In a known manner, the film tube is sealed lengthwise and transverse to the film withdrawal direction at a longitudinal seal device (not illustrated) by means of transverse sealing jaws 07 which are movable with respect to each other. The transverse sealing jaws 07 simultaneously generate the head seam 08 of an already filled tube bag 09 having a bottom seam 10 of the end of the film tube 06 during a sealing process. The film tube 06 is separated between the head seam 08 and a directly adjacent bottom seam 10 by a separating device 12.

A dispensing device 40 having a product container 13 is disposed above the forming shoulder 05. The product container 13 is supplied with product via a filling nozzle 14. The product in the product container 13 is, for example, a powder and is stirred by means of a stirrer 16 driven by a motor 15. A screw tube 41 connects in the dispensing device 14 below the product container 13. The screw tube 41 is disposed coaxially to the forming tube 42 on which the film tube 06 is guided. In the screw tube 41, a screw conveyor 43 is rotationally mounted which can be driven by means of a motor 44.

At the lower end of the screw tube 41 is a flow barrier 45 which is made of two half shells driven by a drive device. By driving the half shells (not illustrated in the drawing), the flow barrier 45 can be opened when the screw conveyor 43 is rotating and can be closed when the screw conveyor 43 is stopped. By closing the flow barrier 45 when the screw conveyor 43 is stopped, it is prevented that in particular powdery product 46 trickles down from the lower opening of the screw tub 41 when the screw conveyor is shut off and thus disrupts the transverse sealing process.

Figure 2:
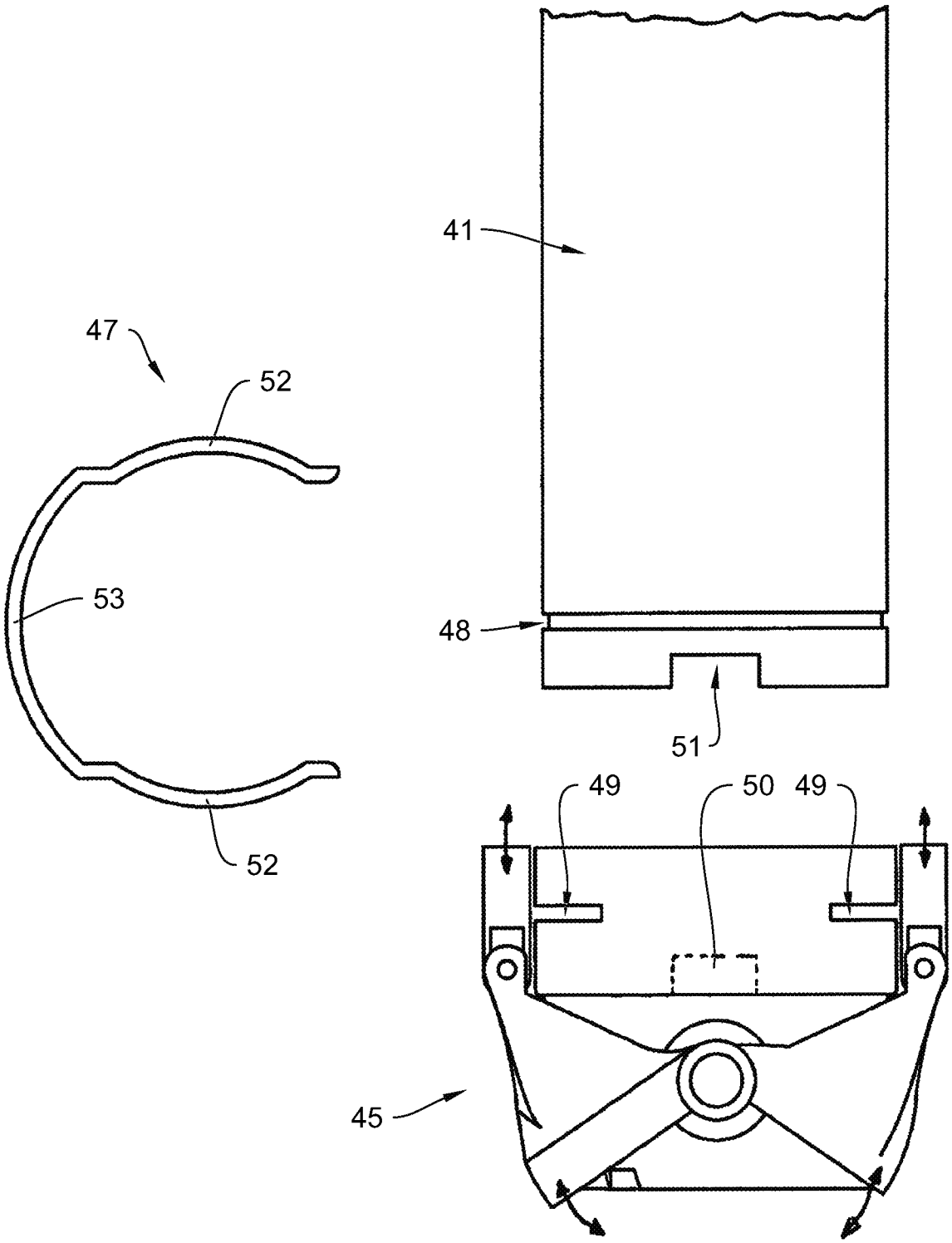
FIG. 2 illustrates in a side view the lower end of the screw tube of the dispensation device according to FIG. 1 having the flow barrier to be fastened thereto and the fastening clamp intended for fastening.

FIG. 2 illustrates in an extracted state the lower end of the screw tube 41, the flow barrier 45 and the fastener 47 which is intended for fastening the flow barrier 45 to the screw tube 41 and is realized like a push clamp.

Figure 3:
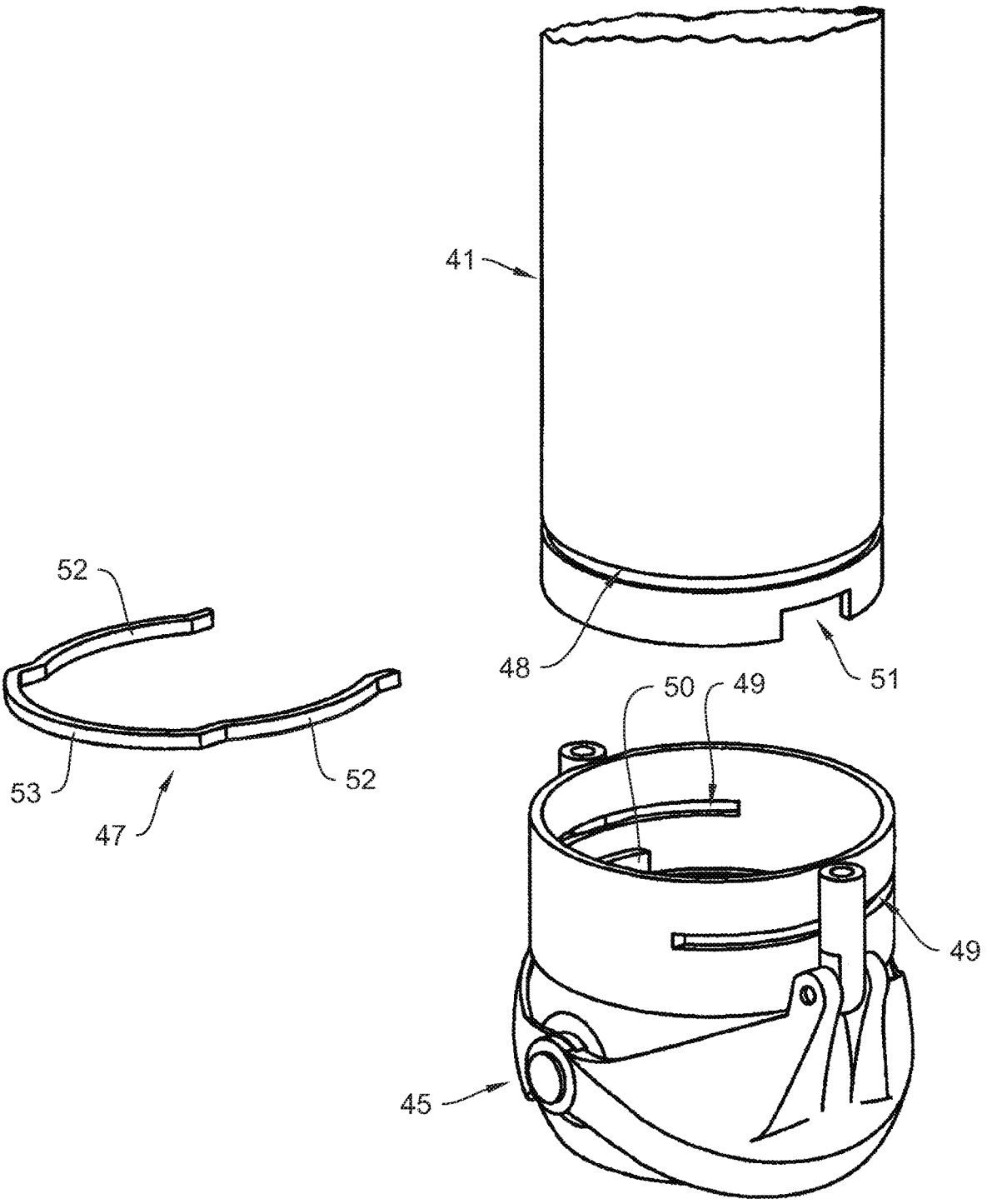
FIG. 3 illustrates in a perspective side view the lower end of the screw tube, the flow barrier and the fastening clamp according to FIG. 2.

FIG. 3 illustrates the screw tube 41, the flow barrier 45 and the push clamp 47 in a perspective side view.

At the lower end of the screw tube 41, a receiving contour 48 is provided which is realized like an annular groove. The groove comprises a rectangular cross section. At the flow barrier 45, two slit-shaped perforations 49 are provided in the wall as receiving contours. When mounting the flow barrier 45 to the screw tube 41, the flow barrier 45 is inserted onto the lower end of the screw tube 41 from the bottom, the angle position between the flow barrier 45 and the screw tube 41 being defined by an anti-rotation element 50. The anti-rotation element 50 is realized like a protrusion on the inner side of the wall of the flow barrier 45 and engages in a cutout 51 at the end cross section of the screw tube 41 in a form-fit manner. As soon as the flow barrier 45 is fit onto the end of the screw tube 41 without play, the push clamp 47, which serves as a fastener in the scope of the invention, is pushed into the perforations 49 from the side, which extend tangentially along the flow barrier 45, until the push clamp 47 surrounds the circumference of the screw tube 41 with both its arms 52.

Figure 4:
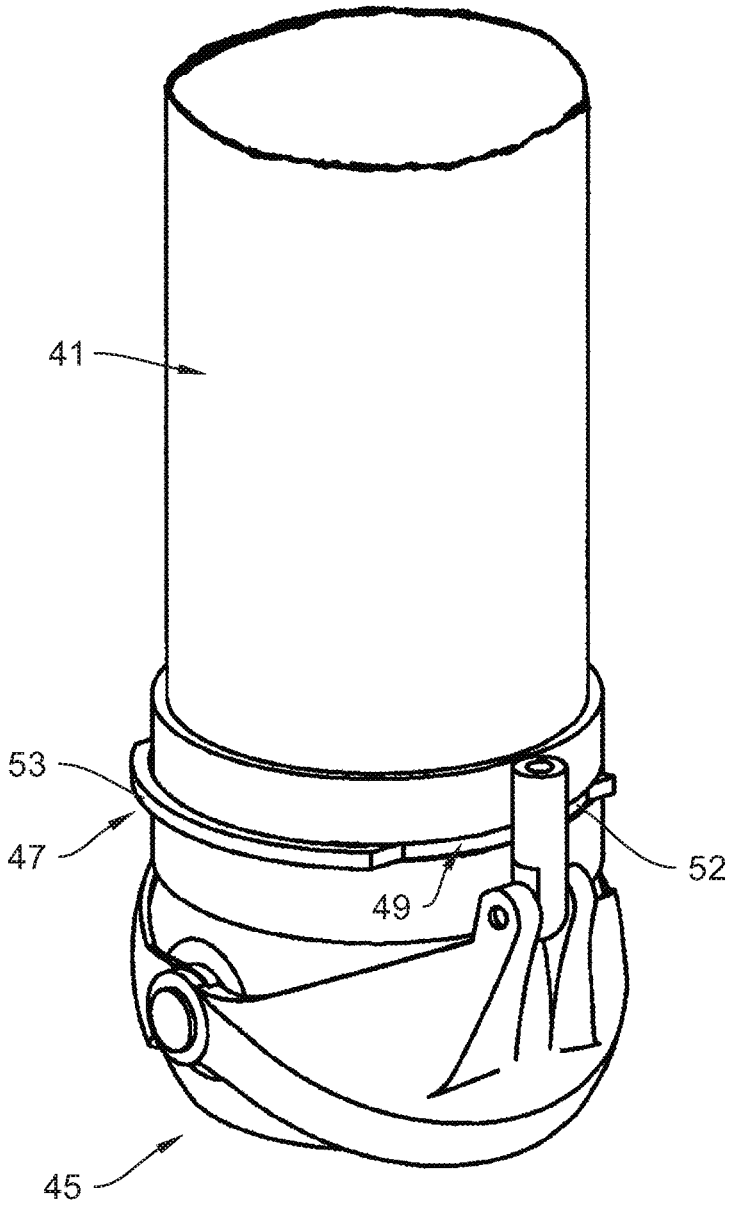
FIG. 4 illustrates in a perspective side view the lower end of the screw tube having the flow barrier fastened thereto by using the fastening clamp according to FIG. 3.

FIG. 4 illustrates the screw tube 41 having the mounted flow barrier 45 in a side view. It can be seen that the two arms 52 of the push clamp 47 engage through the perforations 49 in the wall of the flow barrier 45 and engage in the groove serving as a receiving contour 48 in a form-fit manner. Loosening the flow barrier 45 after mounting the push clamp 47 is only possible if the push clamp is first removed by pulling the push clamp 47 out. A connecting web 53, which connects the two arms 52 to each other in an elastically resilient manner, serves for pulling out the push clamp 47.

Figure 5:
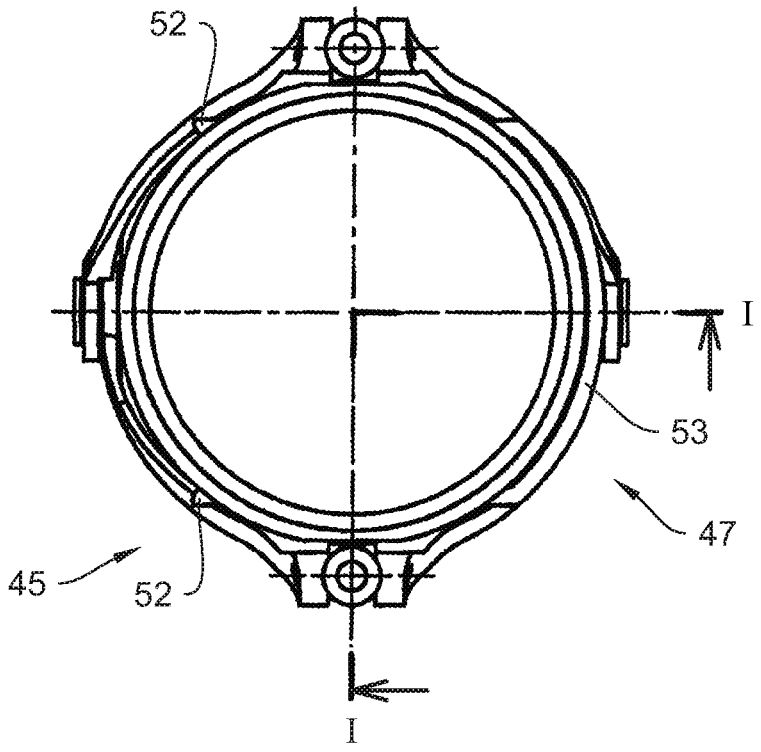
FIG. 5 illustrates from the top the flow barrier and the fastening clamp according to FIG. 4.

FIG. 5 illustrates the flow barrier having the push clamp 47 fastened thereto in a top view. After mounting the push clamp 47, the two arms 52 laterally protrude only with their two free ends.

Figure 6:
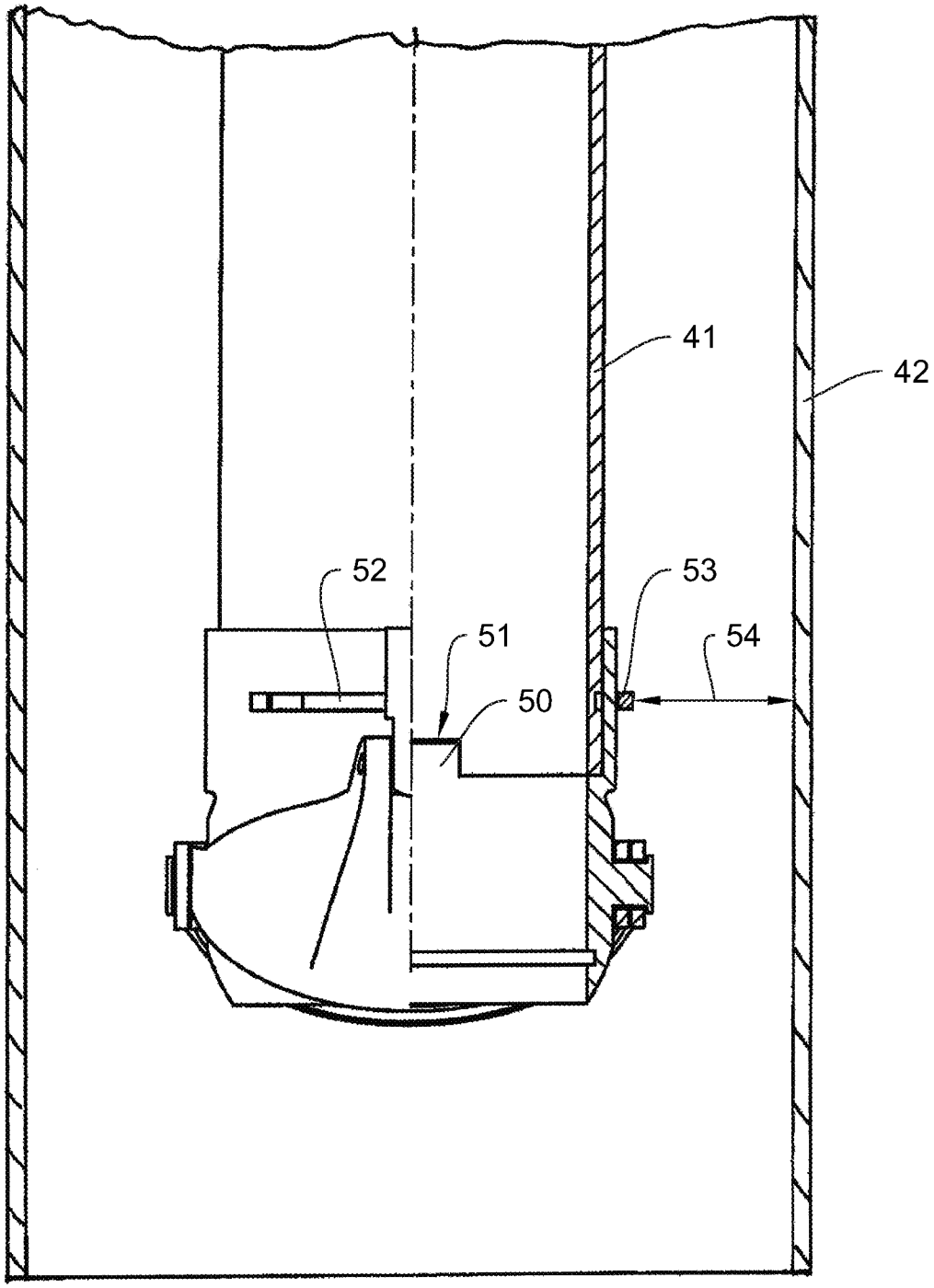
FIG. 6 illustrates in a partial cross section along the cutting line I-I the lower end of the screw tube, the flow barrier and the fastening clamp according to FIG. 4 when disposed in a forming tube.

FIG. 6 illustrates the screw tube 41 having the flow barrier 45 fastened thereto when disposed in the forming tube 42. The distance 54 between the inner side of the forming tube 42 and the outer side of the push clamp 47 in the area of the connecting web 53 is so small that the push clamp 47 can no longer be pulled out from the side after the screw tube 41 has been disposed in the forming tube 42.

The invention claimed is:

1. A dispensing device (40) for being disposed in a forming tube (42) of a tubular bag machine (01) for portioned dispensation of a flowable product (46), the dispensing device comprising:

a one screw conveyor (43) adapted for discharging the product (46), said screw conveyor (43) protruding into a screw tube (41) along a longitudinal axis of the screw conveyor and being able to be rotationally driven by a drive;

a flow barrier (45) fastened at a lower end of the screw tube (41), the flow barrier being adapted to limit an amount of the product (46) from trickling down the screw conveyor beyond the lower end of the screw tube when the screw conveyor (43) is stopped;

at least one first receiving contour (49) provided at the flow barrier (45);

at least one second receiving (48) contour provided at the lower end of the screw tube (41);

a fastener (47) adapted for being inserted into and/or adapted for being pushed through the first receiving contour (49) and second receiving contour (48) for fastening the flow barrier (45) at the lower end of the screw tube (41) in order to fixate the flow barrier (45) with respect to the screw tube; and at least one anti-rotation element (50) at the flow barrier (45), said at least one anti-rotational element engaging a cutout in a lower end surface of the screw tube in a form-fit manner so as to prevent relative rotation therebetween;

wherein the fastener (47) engages the first and second receiving contours (48, 49) at the lower end of the screw tube (41) in a form-fit manner; and wherein at least one of the at least one first receiving contour (49) and the at least one second receiving contour (48) comprises a groove extending circumferentially around the flow barrier or the screw tube, respectively.

2. The dispensing device according to claim 1, wherein an end cross section of the flow barrier (45) facing towards the screw tube (41) is adapted to be placed over the lower end of the screw tube (41), wherein the first receiving contour (49) comprises at least one perforation through a wall of the flow barrier (45), wherein the second receiving contour (48) being formed at the end of the screw tube (41) comprises the groove, said groove extending circumferentially around the screw tube, and wherein said fastener (47) is adapted to be inserted so as to engage through at least one the perforation (49) in the wall of the flow barrier (45) when the flow barrier (45) is disposed at the lower end of the screw tube (41) and engaging in the groove (48) at the lower end of the screw tube (41) in a fixing manner.

3. The dispensing device according to claim 2, wherein the wall of the flow barrier (45) comprises two perforations (49), and wherein the fastener (47) comprises a push clamp, said push clamp (47) comprising two arms (52) which are adapted to be inserted so as to engage through the two perforations (49) and thus each engage in the groove (48) in a fixating manner, said two arms (52) being connected to each other via a connecting portion (53).

4. The dispensing device according to claim 3, wherein the groove (48) and/or the two arms (52) of the push clamp (47) have a rectangular cross section.

5. The dispensing device according to claim 3, wherein the two perforations (49) comprise slits which tangentially perforate a circumference of the flow barrier (45).

6. The dispensing device according to claim 3, wherein the arms (42) of the installed push clamp (47) are disposed in an installation plane extending orthogonally to the longitudinal axis of the screw conveyor (41).

7. The dispensing device according to claim 3, wherein the two arms (52) of the push clamp (47) are adapted to be elastically widened when pushing through the two perforations (49) in the wall of the flow barrier (45).

8. The dispensing device according to claim 3, wherein the connecting portion (53) of the installed push clamp (47) is disposed in a space between the screw tube (41) and the forming tube (42), the space (54) between the screw tube (41) and the forming tube (42) being smaller than an extraction path required for extracting the push clamp (47).

9. The dispensing device according to claim 1, wherein an end cross section of the flow barrier facing towards the screw tube is adapted to be inserted into the lower end of the screw tube, wherein the at least one first receiving contour comprises the groove, said groove extending circumferentially around the flow barrier, wherein the at least one second receiving contour comprises a perforation through a wall of the screw tube, and wherein the fastener is adapted to inserted so as to engage through the perforation in the wall of the screw tube and to engage the groove of the flow barrier in a fixing manner.

10. The dispensing device according to claim 9, wherein the wall of the screw tube comprises two perforations (49), and wherein the fastener (47) comprises a push clamp, said push clamp (47) comprising two arms (52) which can be inserted so as to engage through the two perforations (49) and thus each engage in the groove (48) in a fixating manner, said two arms (52) being connected to each other via a connecting portion (53).

11. The dispensing device according to claim 10, wherein the groove (48) and/or the two arms (52) of the push clamp (47) have a rectangular cross section.

12. The dispensing device according to claim 10, wherein the two perforations (49) comprise slits which tangentially perforate a circumference of the screw tube.

13. The dispensing device according to claim 10, wherein the arms (42) of the installed push clamp (47) are disposed in an installation plane extending orthogonally to the longitudinal axis of the screw conveyor (41).

14. The dispensing device according to claim 10, wherein the two arms (52) of the push clamp (47) are adapted to be elastically widened when pushing through the two perforations (49) in the wall of the screw tube.

15. The dispensing device according to claim 10, wherein the connecting portion (53) of the installed push clamp (47) is disposed in a space between the screw tube (41) and the forming tube (42), the space (54) between the screw tube (41) and the forming tube (42) being smaller than an extraction path required for extracting the push clamp (47).

16. The dispensing device according to claim 1, wherein the at least one anti-rotation element (50) secures a defined mounting angle between the flow barrier (45) and the screw conveyor (41).

17. The dispensing device according to claim 16, the at least one anti-rotation element comprises a protrusion which engages all the cutout (51) in a form-fit manner when the flow barrier (45) is disposed at the lower end of the screw tube (41).

* * * * *